US007341029B2

(12) United States Patent
Stork et al.

(10) Patent No.: US 7,341,029 B2
(45) Date of Patent: Mar. 11, 2008

(54) ADJUSTING DEVICE FOR A CAMSHAFT

(75) Inventors: Holger Stork, Buehl (DE); Minh Nam Nguyen, Buehl (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/148,884

(22) Filed: Jun. 9, 2005

(65) Prior Publication Data

US 2005/0274339 A1 Dec. 15, 2005

(30) Foreign Application Priority Data

Jun. 9, 2004 (DE) ..... 10 2004 028 094

(51) Int. Cl.
*F01L 1/34* (2006.01)

(52) U.S. Cl. ..... 123/90.15; 123/90.17; 123/90.31

(58) Field of Classification Search ..... 123/90.15, 123/90.17, 90.31
See application file for complete search history.

(56) References Cited

U.S. PATENT DOCUMENTS 6,138,622 A 10/2000 Heer ..... 123/90.17
6,499,452 B2 12/2002 Ma ..... 123/90.17
6,712,307 B2 * 3/2004 Iwase et al. ..... 242/433
6,820,579 B2 * 11/2004 Kawamura et al. ..... 123/90.16
2002/0100446 A1 8/2002 Watanabe ..... 123/90.17
2003/0226532 A1 12/2003 Takenake et al. ..... 123/90.17
2004/0107928 A1 * 6/2004 Asada et al. ..... 123/90.16

FOREIGN PATENT DOCUMENTS

JP 11/153008 6/1999
JP 2004-156461 6/2004

* cited by examiner

*Primary Examiner*—Zelalem Eshete
(74) *Attorney, Agent, or Firm*—Davidson, Davidson & Kappel

(57) ABSTRACT

An adjusting device for the rotational position of the camshaft of a reciprocating piston engine relative to the crankshaft has a variator which is designed as a three-shaft transmission having a fixed-to-the-crankshaft input shaft, a fixed-to-the-camshaft output shaft, and an adjusting shaft. The adjusting shaft is coupled nonrotatably to the rotor of a servomotor. To limit the torsional angle between the camshaft and the crankshaft, the adjusting device has limit stops. The servomotor is connected to a control circuit which is designed for controlling the phase velocity of the torsional angle.

12 Claims, 3 Drawing Sheets

ADJUSTING DEVICE FOR A CAMSHAFT

Priority is claimed to German Patent Application No. DE 10 2004 028 094.0, filed Jun. 9, 2004, the entire disclosure of which is incorporated by reference herein.

The present invention is directed to an adjusting device for the rotational position of the camshaft of a reciprocating piston engine relative to the crankshaft, having a variator, which is designed as a three-shaft transmission having a fixed-to-the-crankshaft input shaft, a fixed-to-the-camshaft output shaft, and an adjusting shaft which is coupled nonrotatably to the rotor of a servomotor, the adjusting device having limit stops for limiting the torsional angle between the camshaft and the crankshaft.

BACKGROUND

An adjusting device of the type mentioned at the outset having a planetary gear as a variator and an electronically commutated motor as a servomotor are known in the field. The device has a camshaft gear wheel which is operatively connected via a drive chain to a gear wheel mounted nonrotatably on the crankshaft of the combustion engine. In this context, the camshaft gear wheel is rotatably mounted on the camshaft and is coupled nonrotatably to the input shaft of the variator. The output shaft of the variator is mounted nonrotatably on the camshaft, and the adjusting shaft is operatively connected to the rotor of the servomotor. The stator of the servomotor is permanently bolted to the engine block of the reciprocating piston engine. In the case of a stationary input shaft, a gear ratio preset by the variator, the so-called stationary gear ratio, exists between the adjusting shaft and the output shaft. When the adjusting shaft rotates, the gear ratio between the input shaft and the output shaft increases or decreases depending on the direction of rotation of the adjusting shaft relative to the camshaft gear wheel. This results in a change in the rotational position of the camshaft relative to the crankshaft. A reciprocating piston engine provided with the camshaft adjusting device has the advantage over a comparable reciprocating piston engine not provided with such a device that an improved cylinder charging of the combustion engine is made possible, thereby enabling fuel to be economized, pollutant emissions to be reduced, and/or the power output of the combustion engine to be increased.

To enable the engine function of the combustion engine to be maintained even in the event of a possible malfunction in the adjusting device, the fixed-to-the-crankshaft input shaft has a stop element attached thereto, which, in a position of normal operational use, co-acts with counterstop elements nonrotatably fixed to the camshaft. The limit stops limit the torsional angle of the camshaft relative to the crankshaft to a practical value range. The stop and counterstop elements are positioned in such a way that a defined phase relation results when a counterstop element is positioned against the stop element. The servomotor is linked to a control device which, in certain situations, such as following start-up of the combustion engine, positions the stop element against a counterstop element, in order to make a phase-angle adjustment. In the process, the servomotor is driven in such a way that it is pulse-width-modulated via an output stage with a predefined pulse-no-pulse ratio. However, this entails the disadvantage that different levels of current are supplied to the servomotor, depending on the existing battery voltage and engine temperature, so that different torques and speeds are reached. For that reason, when the stop element is positioned against the counterstop element, the stop element and/or counterstop element can be subject to wear or even to damage.

SUMMARY OF THE INVENTION

An object of the present invention is to provide an adjusting device of the type mentioned at the outset which will render possible a long useful life or service life.

The present invention provides, an adjusting device for the rotational position of the camshaft of a reciprocating piston engine relative to the crankshaft, having a variator, which is designed as a three-shaft transmission having a fixed-to-the-crankshaft input shaft, a fixed-to-the-camshaft output shaft, and an adjusting shaft which is coupled nonrotatably to the rotor of a servomotor, the adjusting device having limit stops for limiting the torsional angle between the camshaft and the crankshaft, wherein the servomotor is connected to a control circuit, which is designed for controlling the phase velocity of the torsional angle.

As a result, the phase velocity of the torsional angle is advantageously independent of the momentary operating conditions of the servomotor, so that the stop element attached to the fixed-to-the-crankshaft input shaft is always positioned more or less with the same speed against the counterstop element attached to the fixed-to-the-camshaft output shaft of the variator. In this context, the phase velocity preferably corresponds to the maximum rotational speed at which the stop is safe from damage.

One preferred embodiment of the present invention provides for a stationary gear ratio to exist between the adjusting shaft and the output shaft, given a stationary input shaft, the adjusting device including a device for outputting a crankshaft speed signal and a device for outputting a speed signal for rotor speed $\omega_{Em}$ of the servomotor, these devices communicating with a signal-processing device designed for generating a setpoint signal for the rotor speed from the crankshaft speed signal, from the stationary gear ratio, and from a setpoint value for the phase velocity, and the setpoint signal being associated with a rotor-speed setpoint input of the control circuit. Phase velocity $\nu$ may be determined in accordance with the formula $$\nu=(\omega_{Cnk}-2\cdot\omega_{Em})/i_g$$

$\omega_{Cnk}$ signifying the speed of the crankshaft, $\omega_{Em}$ the rotor speed of the servomotor rotor, and $i_g$ the stationary gear ratio. From the desired phase velocity $\nu_{Tgt}$, the required target speed $$\omega_{Em,Tgt}=(\omega_{Cnk}-i_{Tgt})/2$$

is calculated at every instant. Thus, in the case of a reciprocating piston engine having an adjusting device for the rotational position of the camshaft, sensors that, for the most part, are already present are used as well for measuring the crankshaft speed and the rotor speed of the servomotor for controlling the phase velocity.

One advantageous embodiment of the present invention provides for the control circuit to be switchable with the aid of a mode selector at least between a first and a second operational mode, in the first operational mode, the phase velocity of the torsional angle and, in the second operational mode, the rotor speed of the servomotor being controlled. In this context, the second operational mode may be used during the starting procedure for the combustion engine, in the case of which the crankshaft speed is measured by an inductive sensor which detects the teeth of a toothed ring disposed on the crankshaft, for example on a flywheel, as long as the sensor still has not sensed any teeth of the toothed ring and/or the measurement signal for the crankshaft speed is still relatively highly disturbed due to the low speed of the crankshaft.

It is beneficial for the control circuit to be switchable with the aid of the mode selector into at least one further operational mode in which the rotor speed of the servomotor is controlled by at least one control parameter that deviates from a control parameter of the second operational mode. This makes it possible for the control parameters for controlling the rotor speed of the servomotor to be adapted to the particular operating state of the servomotor, thereby enabling the rotor speed to be controlled largely independently of the operating conditions of the adjusting device and, in particular, largely independently of the temperature of the transmission oil of the variator.

One useful embodiment of the present invention provides for the servomotor to be an electric motor and for the control circuit to be switchable with the aid of the mode selector into at least one operational mode in which the operating voltage and/or the operating current of the servomotor are controlled. The control may then be adapted even more effectively to the particular operating conditions of the servomotor.

One preferred embodiment of the present invention provides for the mode selector to have at least one input for an operating-state signal that is dependent on the operating state of the reciprocating piston engine, this input being linked to a device for ascertaining the operating state of the reciprocating piston engine, and the mode selector being designed in such a way that the operational mode of the control circuit is set as a function of the at least one operating-state signal. In this context, the operational mode of the control circuit may be set as a function of the operating temperature of the combustion engine, the assumption being that the operating temperature of the servomotor and thus the electrical resistance of the motor winding and the transmission oil temperature of the variator are dependent on the operating temperature of the combustion engine.

It is advantageous for the control circuit to have a limiting device for the torque of the servomotor, and for the limiting device to preferably be tuned to the torque values occurring during adjustment of the adjusting shaft in such a way that the torque is only limited during a positioning operation against a limit stop. This measure limits the power consumption and thus the heating of the servomotor when the adjusting shaft is positioned against the limit stop. Moreover, the battery of the motor vehicle is also saved in the case of a combustion engine installed in a motor vehicle. The torque may be limited, for example, by limiting the operating current and/or the operating voltage of the servomotor to a predefined maximum value.

In one advantageous embodiment of the present invention, the adjusting device has a stop-detection device which includes a first input for the phase-velocity signal and a second input for a torque-limiting signal which is connected to the limiting device, the stop-detection device being designed to sense a positioning of the camshaft against a limit stop in response to a limiting of the torque of the servomotor and a simultaneous reduction in the phase velocity. The stop-detection device makes it possible to easily detect the position of the adjusting shaft against the limit stop and to make a phase-angle adjustment on the basis of a known reference position assigned to the limit stop.

BRIEF DESCRIPTION OF THE DRAWINGS

An exemplary embodiment of the present invention is explained in greater detail in the following with reference to the drawing, whose figures show.

DETAILED DESCRIPTION

Figure 1:
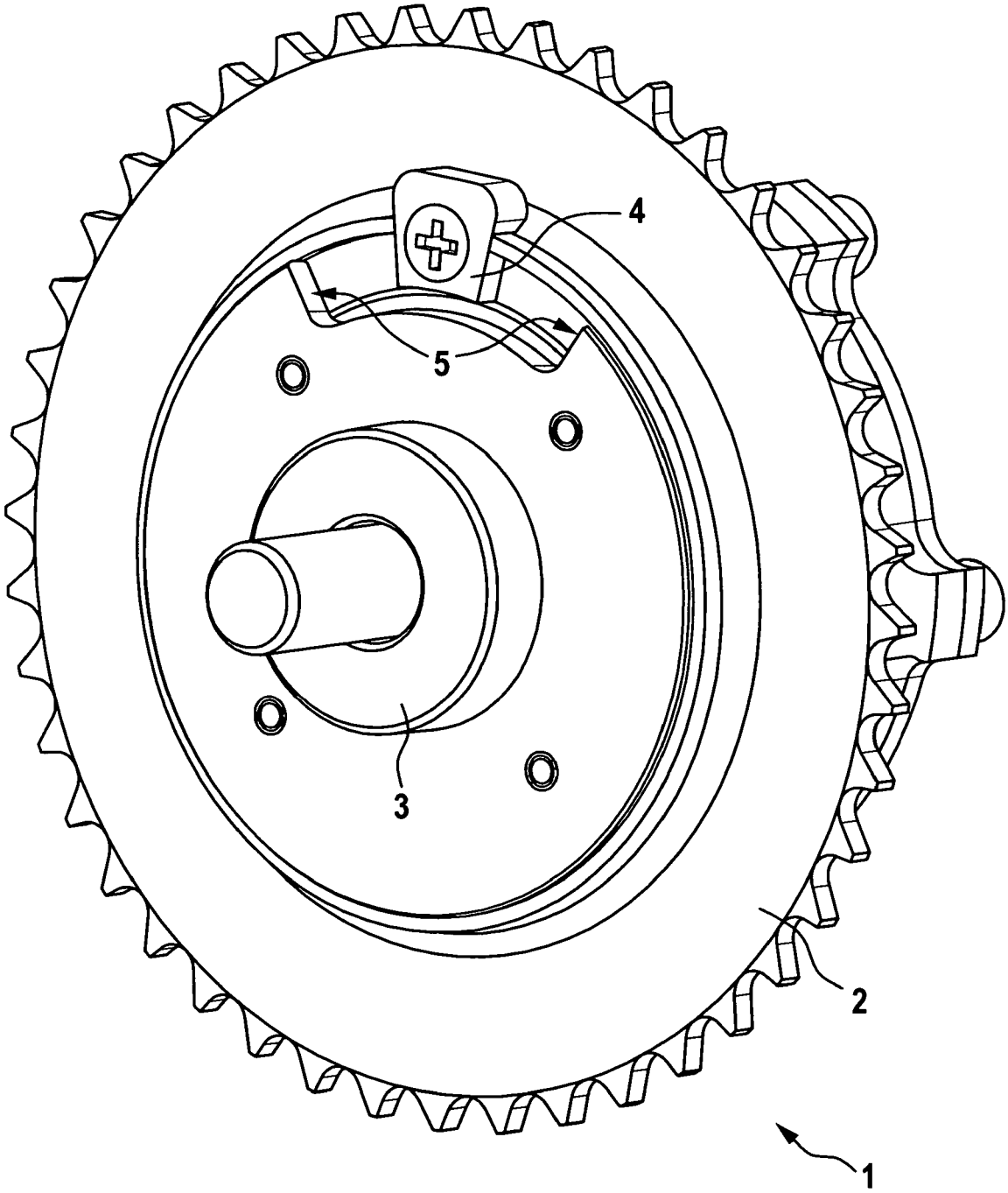
FIG. 1: an adjusting device for adjusting the rotational position of the camshaft of a reciprocating piston engine relative to its crankshaft.

An adjusting device denoted as a whole by 1 for the rotational position of the camshaft relative to the crankshaft of a reciprocating piston engine (not shown in greater detail in the drawing) has a variator, which is designed as a three-shaft transmission having a fixed-to-the-crankshaft input shaft, a fixed-to-the-camshaft output shaft, and an adjusting shaft. The variator may be an epicyclic gear, preferably a planetary gear.

The input shaft is coupled nonrotatably to a camshaft gear wheel 2 which is operatively connected in a generally known manner via a chain or a toothed belt to a crankshaft gear wheel mounted nonrotatably on the crankshaft of the combustion engine. The output shaft is coupled nonrotatably to camshaft 3 which is only partially illustrated in FIG. 1. The adjusting shaft is coupled nonrotatably to the rotor of a servomotor which is located in FIG. 1 on the rear side of adjusting device 1. The variator is integrated in the hub of camshaft gear wheel 2.

To limit the torsional angle between the camshaft and the crankshaft, the adjusting device has limit stops made up of a stop element 4 fixedly connected to the input shaft and of counterstop elements 5. Counterstop elements 5 are fixedly connected to camshaft 3 and cooperate in a position of normal operational use with stop element 4.

Figure 2:
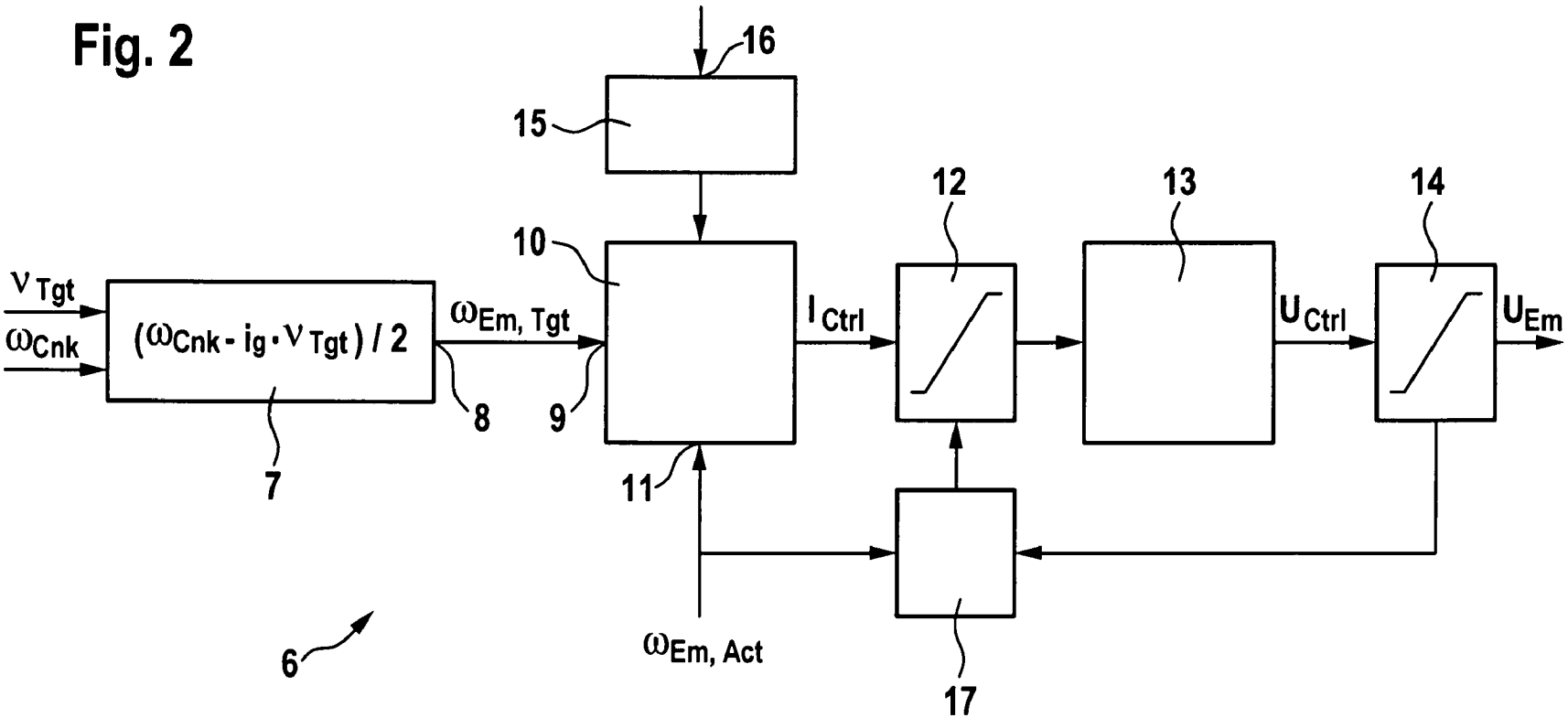
FIG. 2: a control circuit for controlling the phase velocity of the torsional angle between the camshaft and the crankshaft, as well as for controlling the speed of an electric servomotor of the adjusting device.

As a servomotor, an electronically commutated motor is provided, which is connected to a control circuit 6, schematically illustrated in FIG. 2, for controlling the phase velocity of the torsional angle. The design of control circuit 6 is such that, in the normal operation of the reciprocating piston engine, the phase velocity is adjusted when stop element 4 is positioned against one of counterstop elements 5, in such a way that the limit stop is safe from damage.

To control the phase velocity, speed $\omega_{Cnk}$ of the crankshaft and rotor speed $\omega_{Em}$ of the servomotor are measured with the assistance of sensors. From the thus ascertained measurement signals and known stationary gear ratio $i_g$ of the variator, a setpoint value for rotor speed $\omega_{Em,Tgt}$ of the servomotor is calculated with the assistance of a signal-processing device 7:

$$\omega_{Em,Tgt}=(\omega_{Cnk}-i_g\cdot\nu_{Tgt})/2$$

Speed $\omega_{Cnk}$ of the crankshaft is advantageously measured by an inductive sensor which detects the teeth of a toothed ring disposed on the crankshaft, for example on a flywheel, as they rotate past. Rotor speed $\omega_{Em}$ of the servomotor is preferably measured with the aid of magnetic field sensors mounted on the stator of the electronically commutated motor which detect the magnetic segments arranged on the periphery of the permanent-magnetic rotor of the electronically commutated motor, as they rotate past.

Discernible in FIG. 2 is that signal-processing device 7 has an output 8 for rotor-speed setpoint signal $\omega_{Em,Tgt}$ that is linked to a rotor-speed setpoint input 9 of a controller 10. Moreover, controller 10 has an actual-value input 11 which is linked to the magnetic field sensors of the electronically commutated motor and at which a speed-measurement signal $\omega_{Em,Act}$ of the servomotor is present. In controller 10, a system deviation is formed between rotor-speed setpoint signal $\omega_{Em,Tgt}$ and speed-measurement signal $\omega_{Em,Act}$. As a function of the system deviation, a signal $I_{Ctrl}$ is generated for the winding current of the servomotor in such a way that the system deviation is reduced in response to the corresponding winding current being output to the servomotor. Signal $I_{Ctrl}$ for the winding current is limited by a current-limiting device 12 to a permissible value range.

An output of current-limiting device 12 is linked to an input of a current/voltage converter 13, which converts the limited winding current signal into a corresponding signal for an electrical voltage to be fed to the winding of the servomotor. This electrical voltage is limited by a voltage-limiting device 14 to a permissible value range and subsequently fed via an output stage (not shown in greater detail in the drawing) to the winding of the servomotor.

The control circuit is switchable with the aid of a mode selector 15 between a first and a second operational mode. In the first operational mode, the phase velocity of the torsional angle and, in the second operational mode, the rotor speed of the servomotor are controlled. Mode selector 15 has an input 16 for an operating-state signal that is dependent on the operating state of the reciprocating piston engine. Mode selector 15 is designed in such a way that the operational mode of the control circuit is set as a function of the operating-state signal. The second operational mode, in which the rotor speed of the servomotor is controlled, is used during the starting phase of the combustion engine when the measurement signal for the crankshaft speed is not yet available or is still relatively highly disturbed. As soon as the speed of the combustion engine exceeds a predefined limiting value, the switch is made to the first operational mode in order to control the phase velocity of the torsional angle.

Figures 3, 4, 5, 6, 7:
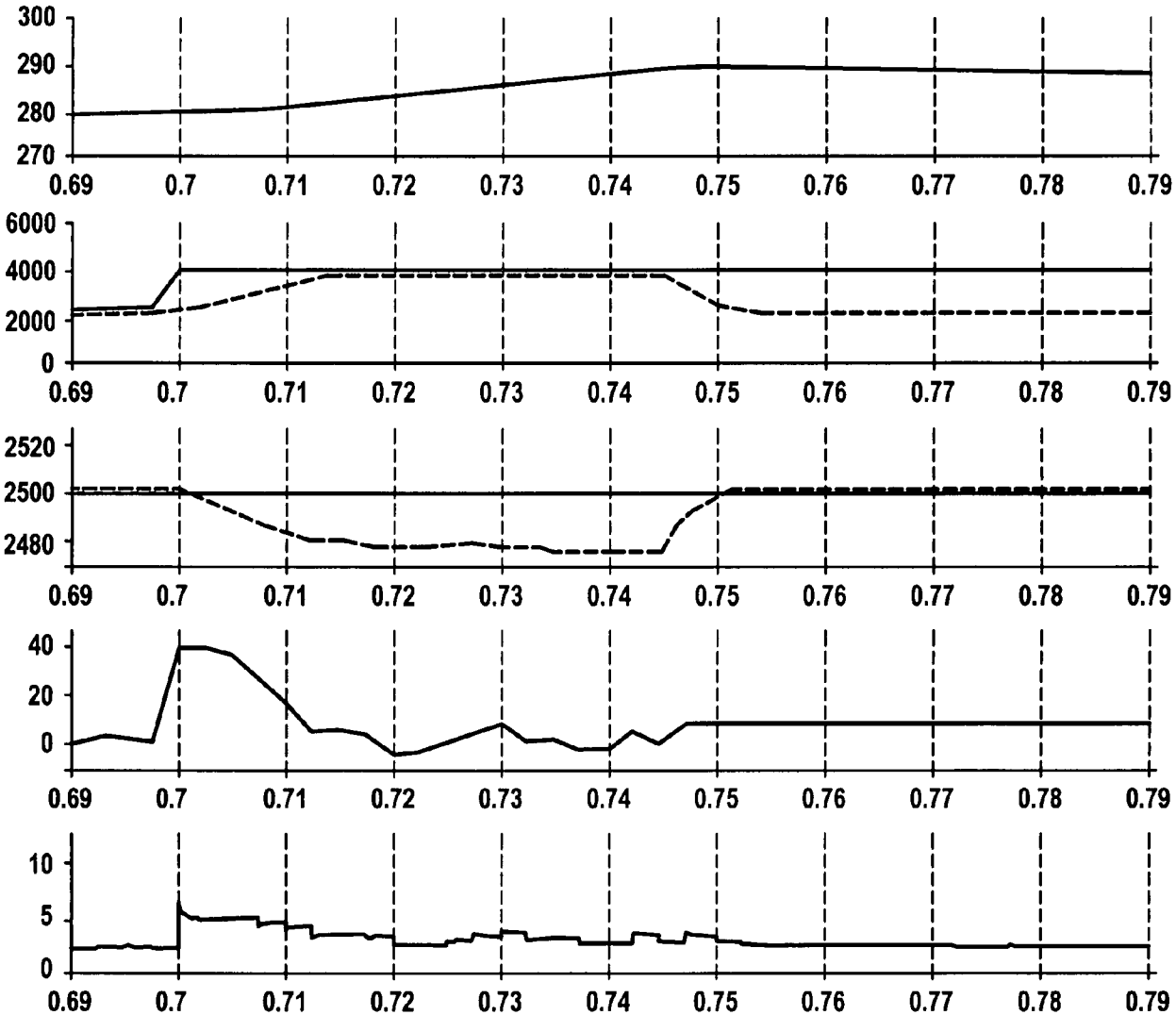
FIG. 3: a graphic representation of the characteristic curve of the phase angle, the time in seconds being plotted on the abscissa, and the phase angle in degrees crankshaft being plotted on the ordinate.
FIG. 4: a graphic representation of the characteristic curve of a setpoint signal and of an actual value signal for the speed of the servomotor, the time in seconds being plotted on the abscissa, and the speed in revolutions per minute being plotted on the ordinate.
FIG. 5: a graphic representation of the characteristic curve of the speed of the input shaft (solid line) and of the characteristic curve of the camshaft speed (broken line) of a variator of the adjusting device, the time in seconds being plotted on the abscissa, and the speed in revolutions per minute being plotted on the ordinate.
FIG. 6: a graphic representation of the winding current of the servomotor, the time in seconds being plotted on the abscissa, and the current intensity in amperes being plotted on the ordinate.
FIG. 7: a graphic representation of the winding voltage of the servomotor, the time in seconds being plotted on the abscissa, and the voltage in volts being plotted on the ordinate.

In FIGS. 3 through 7, an actual-value signal for the phase angle (FIG. 3), the signals for the rotational speeds of the three shafts of the variator (FIGS. 4 and 5), the signals for the winding current (FIG. 6), and the winding voltage (FIG. 7) are graphically illustrated on the basis of an example for a limit-stop travel. As is discernible in FIG. 3, before limit-stop travel ($t\leqq 0.7$s) is begun, the phase angle amounts to about 280 degrees crankshaft (FIG. 3). In this context, the rotor speed of the servomotor and the speeds of the camshaft and of the input shaft of the servomotor are about 2,500 rpm.

During the limit-stop travel, a setpoint phase velocity of 300 degrees crankshaft is required. From this desired phase velocity, the setpoint value for rotor speed $\omega_{Em,Tgt}$ of the servomotor is determined, and the servomotor is energized accordingly. It is clearly shown by the broken line in FIG. 4 that, starting at $t=0.7$s, the rotor speed of the servomotor increases. As a result, camshaft 3 no longer rotates at the speed of camshaft gear wheel 2, but at a lower speed, as shown by a broken line in FIG. 5. This leads to an increase in the active phase angle of 280 degrees crankshaft at $t=0.7$s to approximately 290 degrees crankshaft at $t\geqq 0.747$s.

When the limit stop is reached, the phase angle cannot be further reduced. Therefore, the rotor speed (shown in FIG. 4 by a broken line) of the servomotor drops back to about 2,500 rpm at $t\geqq 0.753$s. In the process, the current consumption and, thus, the torque of the servomotor are limited.

To make this possible, adjusting device 1 has a stop-detection device 17 which includes a first input for the phase-velocity signal and a second input for a torque-limiting signal that is linked to voltage-limiting device 14. The stop-detection device is designed to sense a positioning of camshaft 3 against a limit stop in response to a limiting of the torque and/or of the winding voltage of the servomotor and a simultaneous reduction in the phase velocity.

It is discernible in FIG. 2 that, in order to reduce the current consumption of the servomotor during positioning of stop element 4 against counterstop element 5, stop-detection device 17 is linked to current-limiting device 12.

It should also be mentioned that control circuit 6, mode selector 15, and stop-detection device 17 may also be implemented in the form of a computer program in a microcontroller.

What is claimed is:

1. An adjusting device for adjusting a rotational position of a camshaft relative to a crankshaft of a reciprocating piston engine, the adjusting device comprising:

an input shaft rotationally fixed to the crankshaft;

an output shaft rotationally fixed to the camshaft;

a servomotor;

an adjusting shaft nonrotatably coupled to the rotor of a servomotor;

limit stops configured to limit a torsional angle between the camshaft and the crankshaft; and a control circuit connected to the servomotor and configured to control a phase velocity of the torsional angle;

wherein a stationary gear ratio exists between the adjusting shaft and the output shaft, and further comprising a crankshaft speed signal device for outputting a crankshaft speed signal, a rotor speed signal device for outputting a speed signal for a rotor speed $\omega_{Em}$ of the servomotor, and a signal-processing device connected to the crankshaft speed signal device and the rotor speed signal device and configured to generate a setpoint signal for the rotor speed from the crankshaft speed signal, from the stationary gear ratio, and from a setpoint value for the phase velocity, the setpoint signal being associated with a rotor-speed setpoint input of the control circuit.

2. The adjusting device as recited in claim 1, wherein the input shaft, output shaft and adjusting shaft are part of a three-shaft transmission of a variator.

3. The adjusting device as recited in claim 1, further comprising a mode selector capable of switching the control circuit at least between a first and a second operational mode; in the first operational mode, the phase velocity of the torsional angle is controlled and, in the second operational mode, the rotor speed of the servomotor is controlled.

4. The adjusting device as recited in claim 3, wherein the control circuit is switchable using the mode selector to at least one further operational mode in which the rotor speed of the servomotor is controlled by at least one further control parameter that deviates from a second control parameter of the second operational mode.

5. The adjusting device as recited in claim 1 wherein the servomotor is an electric motor, and further comprising a mode selector capable of switching the control circuit into at least one operational mode in which at least one of the operating voltage and the operating current of the servomotor are controlled.

6. The adjusting device as recited in claim 1 further comprising a mode selector having at least one input and an ascertaining device configured to ascertain an operating state of the reciprocating piston engine, wherein the at least one input is linked to the ascertaining device for receiving at least one operating-state signal indicative of the operating state, and wherein the mode selector is configured to set an operational mode of the control circuit as a function of the at least one operating-state signal.

7. The adjusting device as recited in claim 1 wherein the control circuit includes a limiting device for limiting a torque of the servomotor.

8. The adjusting device as recited in claim 7, wherein the limiting device is tuned to the torque values occurring during adjustment of the adjusting shaft so as to limit the torque only during a positioning operation against one of the limit stops.

9. The adjusting device as recited in claim 7, further comprising a stop-detection device including a first input for a phase-velocity signal and a second input for a torque-limiting signal, the first input being connected to the limiting device, and wherein the stop-detection device is configured to sense a positioning of the camshaft against a limit stop in response to a limiting of the torque of the servomotor and a simultaneous reduction in the phase velocity.

10. An adjusting device for adjusting a rotational position of a camshaft relative to a crankshaft of a reciprocating piston engine, the adjusting device comprising:

an input shaft rotationally fixed to the crankshaft;

an output shaft rotationally fixed to the camshaft;

a servomotor;

an adjusting shaft nonrotatably coupled to the rotor of a servomotor;

limit stops configured to limit a torsional angle between the camshaft and the crankshaft; and a control circuit connected to the servomotor and configured to control a phase velocity of the torsional angle;

wherein the control circuit includes a limiting device for limiting a torque of the servomotor;

wherein the limiting device is tuned to the torque values occurring during adjustment of the adjusting shaft so as to limit the torque only during a positioning operation against one of the limit stops.

11. An adjusting device for adjusting a rotational position of a camshaft relative to a crankshaft of a reciprocating piston engine, the adjusting device comprising:

an input shaft rotationally fixed to the crankshaft;

an output shaft rotationally fixed to the camshaft;

a servomotor;

an adjusting shaft nonrotatably coupled to the rotor of a servomotor;

limit stops configured to limit a torsional angle between the camshaft and the crankshaft;

a control circuit connected to the servomotor and configured to control a phase velocity of the torsional angle, wherein the control circuit includes a limiting device for limiting a torque of the servomotor; and a stop-detection device including a first input for a phase-velocity signal and a second input for a torque-limiting signal, the first input being connected to the limiting device, and wherein the stop-detection device is configured to sense a positioning of the camshaft against a limit stop in response to a limiting of the torque of the servomotor and a simultaneous reduction in the phase velocity.

12. An adjusting device for adjusting a rotational position of a camshaft relative to a crankshaft of a reciprocating piston engine, the adjusting device comprising:

an input shaft rotationally fixed to the crankshaft;

an output shaft rotationally fixed to the camshaft;

a servomotor;

an adjusting shaft nonrotatably coupled to the rotor of a servomotor;

limit stops configured to limit a torsional angle between the camshaft and the crankshaft; and a control circuit connected to the servomotor and configured to control a phase velocity of the torsional angle;

wherein the servomotor is an electric motor, and further comprising a mode selector capable of switching the control circuit into at least one operational mode in which at least one of the operating voltage and the operating current of the servomotor are controlled;

wherein the at least one operational mode includes a first operational mode during which the phase velocity is controlled and a second operational mode during which a rotor speed of the servo motor is controlled.

* * * * *

UNITED STATES PATENT AND TRADEMARK OFFICE

CERTIFICATE OF CORRECTION

PATENT NO. : 7,341,029 B2
APPLICATION NO. : 11/148884
DATED : March 11, 2008
INVENTOR(S) : Holger Stork and Min Nam Nguyen It is certified that error appears in the above-identified patent and that said Letters Patent is hereby corrected as shown below:

On the Title Page, Item -56- References Cited, U.S. Patent Document 2003/0226532 the Inventor's name should read --Takenaka et al.--

In column 2, line 50 should read: --$i_g \cdot \upsilon_{Tgt}$--

Signed and Sealed this

Eighth Day of July, 2008

JON W. DUDAS
*Director of the United States Patent and Trademark Office*